United States Patent [19]

Miyako et al.

[11] Patent Number: 4,664,544

[45] Date of Patent: May 12, 1987

[54] PRINTER FOR SELECTIVELY RECEIVING CUT PAPER OR ROLL PAPER

[75] Inventors: Shunichi Miyako; Hiroyuki Horiuchi, both of Osaka, Japan

[73] Assignee: Sharp Kabushiki Kaisha, Osaka, Japan

[21] Appl. No.: 679,206

[22] Filed: Dec. 6, 1984

[30] Foreign Application Priority Data

Dec. 14, 1983 [JP] Japan ..... 58-193267[U]

[51] Int. Cl.[4] ..... B41J 11/00

[52] U.S. Cl. ..... 400/605; 400/693

[58] Field of Search ..... 400/605, 693

[56] References Cited

U.S. PATENT DOCUMENTS

| | | | |
|---|---|---|---|
| 4,439,051 | 3/1984 | Lawter | 400/605 |
| 4,452,543 | 6/1984 | Adkisson et al. | 400/605 |
| 4,475,833 | 10/1984 | Sawicki | 400/605 |
| 4,488,829 | 12/1984 | Hidaka | 400/605 |
| 4,504,161 | 3/1985 | Volke et al. | 400/605 |

*Primary Examiner*—Clifford D. Crowder

*Attorney, Agent, or Firm*—Flehr, Hohbach, Test, Albritton & Herbert

[57] ABSTRACT

A printer adapted for cut paper to be supplied from a table and inserted into a paper inlet for printing thereon is also provided with a means for holding a roll of printing paper so that the paper from the roll can be inserted through the same paper inlet so that the printer can print both on cut paper and on roll paper.

2 Claims, 5 Drawing Figures

PRINTER FOR SELECTIVELY RECEIVING CUT PAPER OR ROLL PAPER

BACKGROUND OF THE INVENTION

This invention relates to a printer which can be used for paper of different sizes and forms.

Among the printers used, for example, as peripheral equipment of computers, there have been available those which could use paper of different sizes. Printers of this type, however, were always for cut paper and were not adaptable to roll paper. The present invention has been achieved in view of this disadvantage. It is therefore an object of this invention to provide a convenient printer for which the size of paper to be used can be freely selected and for which both cut paper and roll paper can be used.

DETAILED DESCRIPTION OF THE INVENTION

Figure 1:
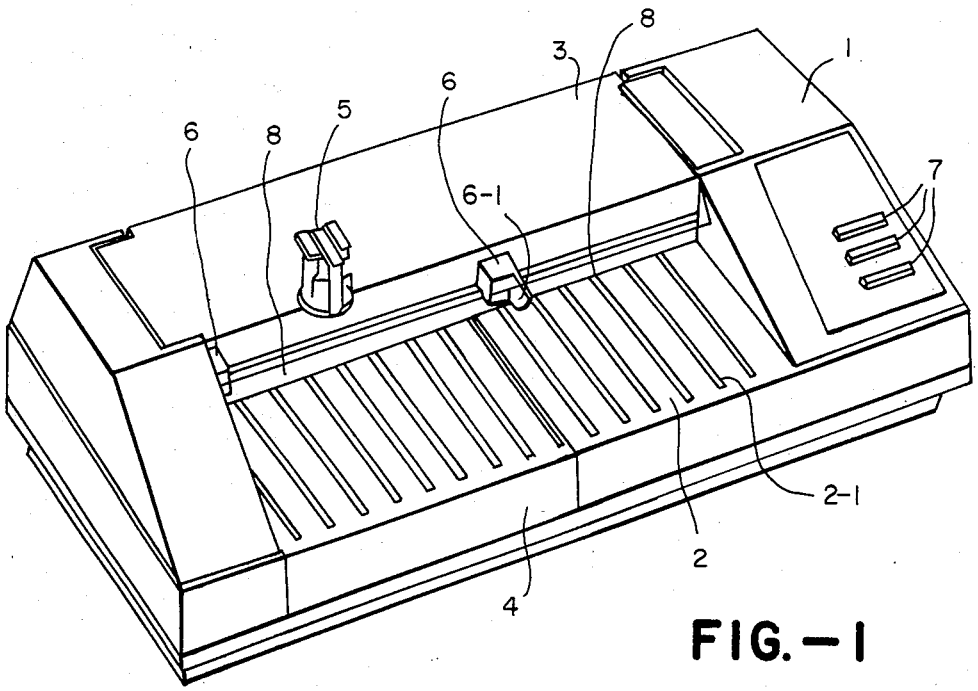
FIG. 1 is a perspective external view of a plotter printer according to this invention.
Figure 2:
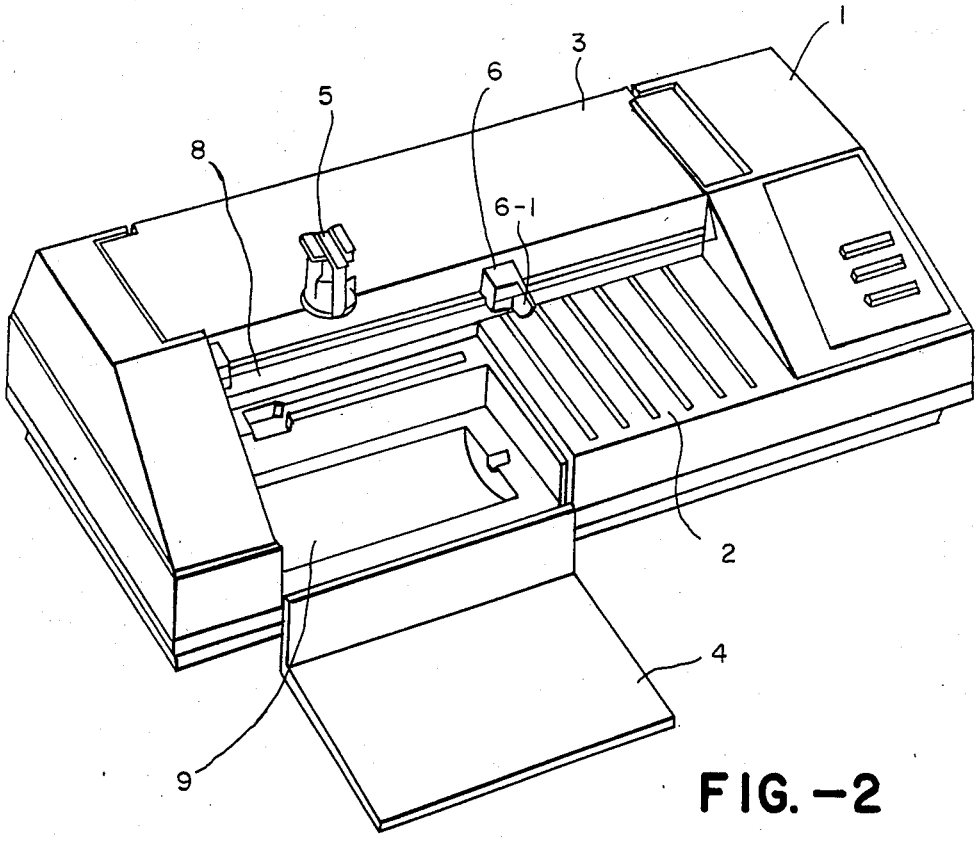
FIG. 2 is a view for showing the structure of the roll paper holder section of the printer of FIG. 1.
Figure 3:
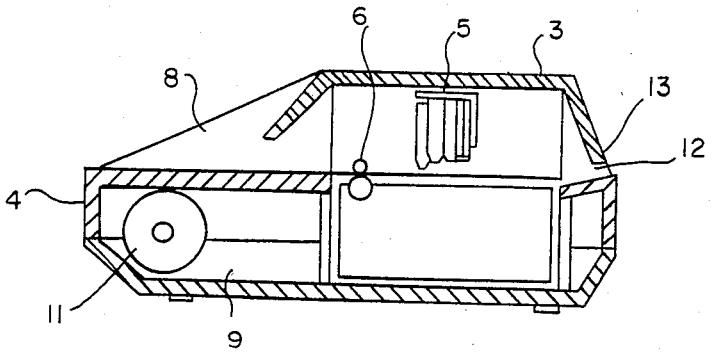
FIG. 3 is a cross sectional view of the printer of FIG. 1.

Referring now to the figures, No. 1 is a printer housing and No. 2 is a table for supplying printing paper. On the surface of the table 2, there are a plurality of protruding rails 2-1 at fixed intervals for the purpose of reducing the friction with the printing paper.

No. 3 is a cover for the internal printing section and the printing paper is set inside the printing section through the paper inlet by manual insertion 8. No. 4 is a lid for opening frontwise a portion of the paper supplying table 2, No. 5 is a pen holder for holding pens of four different colors (red, blue, green and black) and No. 6 are paper feeders which hold the two sides of the printing paper in accordance with its size. The right-hand feeder 6-1 is adapted to be movable in accordance with the size of the paper such as A4, A5, B5 and postcard size.

No. 7 shows a paper feed key for moving the print paper before and after the printing and a printing color selection key; No. 9 is a chamber formed as a part of the table 2 for holding a roll of paper and can be opened and closed by means of the lid 4; No. 10 is a pen container for containing a cylindrical pen holder for holding spare pens; No. 11 is a roll of paper; and No. 12 is an opening through which the printing paper is taken out. A paper cutter 13 is provided above the opening 12 for taking out paper.

Figure 4:
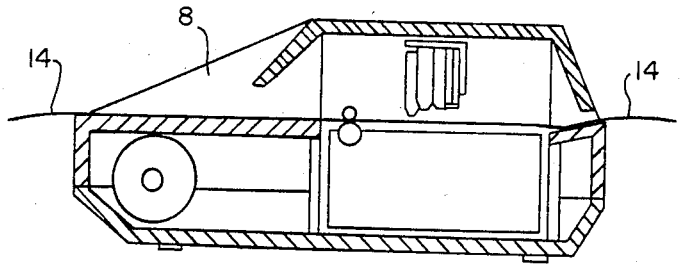
FIG. 4 is a cross sectional view showing how a sheet of cut paper is used.
Figure 5:
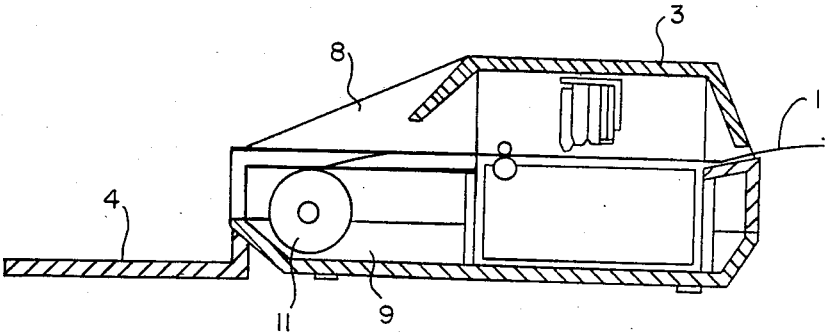
FIG. 5 is a cross sectional view showing how roll paper is used.

The construction described above allows cut paper 14 of any appropriate size to be inserted through the entrance 8 to be printed thereon as shown in FIG. 4. As shown in FIG. 5, furthermore, the user can open the lid 4 to install a roll of paper 11 in the roll paper holding section and insert one end thereof into the inlet 8 so that printing can be effected on that roll of paper. This is how a printer of this invention can print both on cut paper and roll paper.

The position of the slidable paper feeder 6-1 is electrically monitored so that the pen will not move to a section where there is no paper to print on.

In summary, a printer of this invention is very convenient because it comprises a roll paper holding section inside the table for supplying cut paper which is in front of a paper inlet by manual insertion and the roll of paper held inside can be supplied to the inlet so that both cut paper and roll paper can be used with this printer.

What is claimed is:

1. A printer comprising a paper inlet for manual insertion of cut paper for printing thereon, and a table for carrying cut paper in front of said paper inlet, said table having a chamber which is formed as a part thereof, said chamber containing therein a roll of paper such that paper from said roll is fed into said paper inlet, a front portion of said table forming a lid which serves to open and close said chamber.

2. The printer of claim 1 wherein paper from said roll is directly fed into said paper inlet from the front.

* * * * *